US005996827A

United States Patent [19]

Splane

[11] Patent Number: 5,996,827

[45] Date of Patent: Dec. 7, 1999

[54] ENVIRONMENTAL TANK

[76] Inventor: Benjamin R. Splane, 120 Michael Dr., Franklin, La. 70538

[21] Appl. No.: 09/163,066

[22] Filed: Sep. 28, 1998

[51] Int. Cl.[6] ..... B65D 88/54

[52] U.S. Cl. ..... 220/1.5; 220/668

[58] Field of Search ..... 220/1.5, 562, 668, 220/567.2, 23.91, 89.1, 89.2, 4.12; 222/185.1, 181.1

[56] References Cited

U.S. PATENT DOCUMENTS

| | | | |
|---|---|---|---|
| 4,065,022 | 12/1977 | Cainaud | 220/647 |
| 4,699,294 | 10/1987 | Carlin, Jr. . | |
| 4,934,553 | 6/1990 | McCarthy | 220/454 |
| 5,058,747 | 10/1991 | Decroix et al. | 206/599 |
| 5,198,398 | 3/1993 | Duijn | 220/562 |
| 5,330,070 | 7/1994 | Gerhard et al. | 220/562 |
| 5,529,222 | 6/1996 | Toth et al. | 222/181.3 |
| 5,603,359 | 2/1997 | Geiser | 141/1 |
| 5,647,514 | 7/1997 | Toth et al. | 222/181.3 |

*Primary Examiner*—Stephen Castellano
*Attorney, Agent, or Firm*—John D. Jeter

[57] ABSTRACT

A closable and sealable environmental tank is supported and protected by a frame and has at least four openings, each opening subject to closure by means of screw thread secured elements. One port is a manway, with a removable closure. A second port is arranged to receive a top service adapter assembly having a connector nipple, a valve, and a standpipe or a flow port adapter for bottom discharge service. The third port is adapted to receive top discharge pressurization and pressure control assembly, or a safety blow down adapter for bottom discharge service. The fourth port is on the bottom of the tank and is adapted to receive a drain port adapter assembly, for bottom discharge service comprising at least a delivery tube, a control valve, and a connector nipple, or to receive a blind flange closure for top discharge service.

5 Claims, 2 Drawing Sheets

ENVIRONMENTAL TANK

This invention pertains to an improved tank for use in handling materials controlled in accordance with government regulatory agency guidelines. More specifically it is usable for storing, transporting, and handling of liquids, mixes and emulsions that will flow by gravity or under pressure. The tank is intended to be crane, and forklift, handled and comprise deck cargo and the like situations.

BACKGROUND OF THE INVENTION

The tendency for industrial by-products and wastes to contaminate the environment is well known. Petroleum related industrial activities, well drilling and well servicing activities especially, can rapidly degrade the environment. Handling, storage, and transport of such materials is now regulated in almost every part of the world involved. Special tanks are required in the U.S., mostly by the U.S. Department of Transportation. When offshore activities are involved, the U.S. Coast Guard participates in regulatory processes.

Tanks that may be transferred between vessels and between vessels and shore have protective framework that provides lifting, handling, stackability, and barrier functions.

The tanks themselves have to be closable to the extent that they can hold pressure and will not spill if capsized. The closures must provide clean out accessibility, fill and dump, and pressurizing, or pressure control, ducts and valves.

SUMMARY OF THE INVENTION

An environmental tank is supported in a frame that generally surrounds and protects the tank. The tank has an openable covered manway for clean-up access and two other topside ports. The topside ports are each arranged to receive accessories that are required for top discharge service or to receive accessories that are required for bottom discharge service. The tank is also provided with a bottom port that is adapted to receive an outlet accessory that is required for bottom discharge service or to receive an accessory that is required for top discharge service. Accessories are provided for adapting all three ports for the elected type of service.

For top discharge service, one top port accessory is provided that includes a standpipe that reaches to the bottom inside the tank, attaches to the port and includes a valve, an ell and a discharge coupler nipple. A second top port is provided with an accessory that includes a rupture safety discharge disc, a pressurizing nipple and valve, two pressure gauges, and means for attachment to the port. The bottom port accessory includes a blind cover plate arranged for sealably fastening to the port.

For bottom discharge service, one top port accessory includes a filler line attachment nipple and means for attachment to the port. A second accessory for a top port is a safety assembly that includes a safety pressure release valve and means to attach to the port. For the bottom port a discharge manifold includes at least a manual control valve, an internal emergency close down valve for remote actuation, a discharge tube connector nipple and means for fastening to the bottom port.

BRIEF DESCRIPTION OF DRAWINGS

In the drawings wherein like features have similar captions.

DETAILED DESCRIPTION OF DRAWINGS

Figure 1:
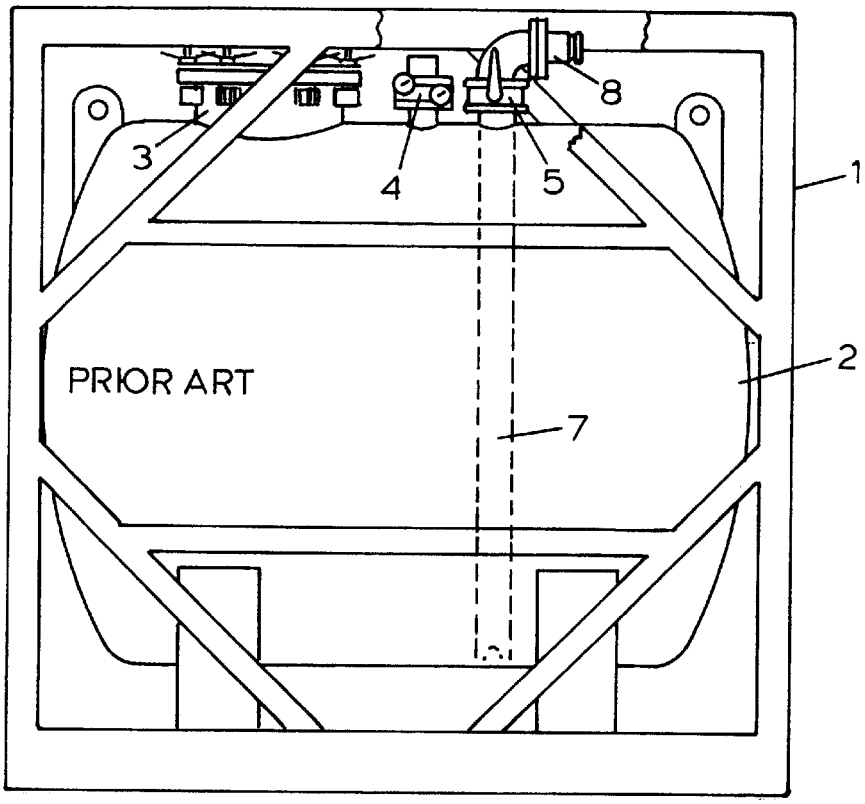
FIG. 1 is a side view of a top discharge tank according to prior art.

In the drawings certain features well established in the art and not bearing upon points of novelty are omitted in the interest of descriptive clarity. Such omitted features may include weld lines, some threaded fasteners, threaded joints, gaskets, pins and the like.

In FIG. 1 frame 1 supports and protects generally cylindrical tank 2. Top discharge outlet 8 is controlled by valve 5 which receives fluid from the tank by way of stand pipe 7. Pressure and pressurization is the function of manifold 4. Pressure can be applied by this route which provides safety pressure release, gages, and a rupture disc. Manway 3 has a wing bolt attached removable cover.

Figure 2:
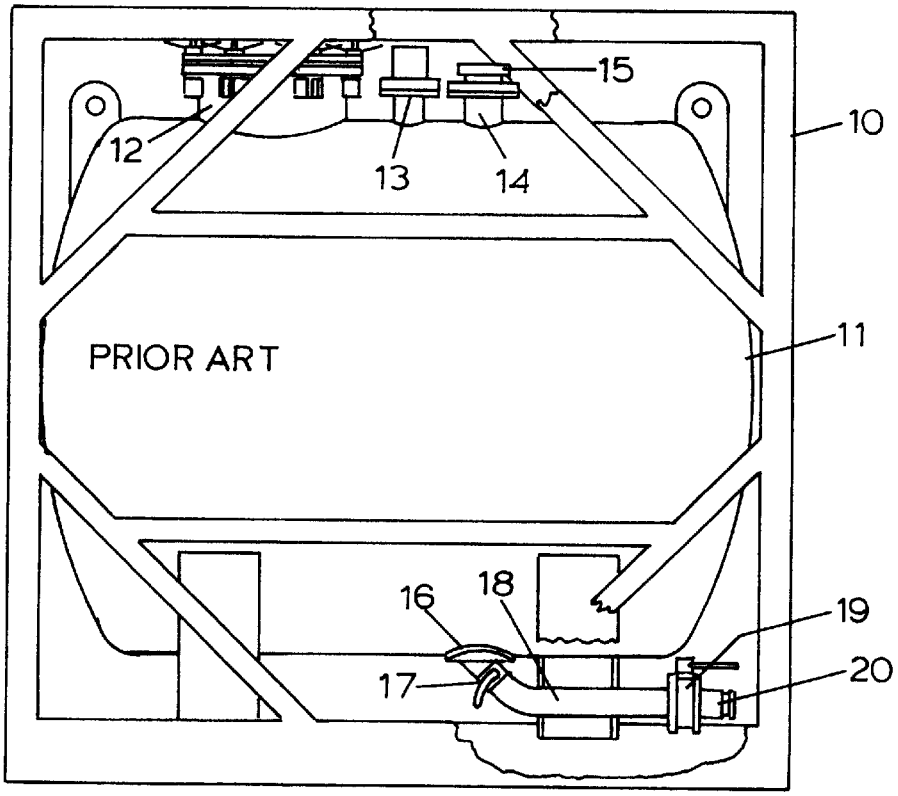
FIG. 2 is a side view of a bottom discharge tank according to prior art.

In FIG. 2, frame 10 supports bottom discharge tank 11 which has fill port connector 15 on fill port 14. Fitting 13 is a safety pressure release. Manway 12 has a wing bolt retained cover. Lower port flange 16 provides for attachment of discharge assembly 18 which includes an internal emergency close down valve 17, manually controlled valve 19 and discharge connector 20. Not shown are the usual outboard supports that prevent cantilever strain on the discharge assembly.

Figure 3:
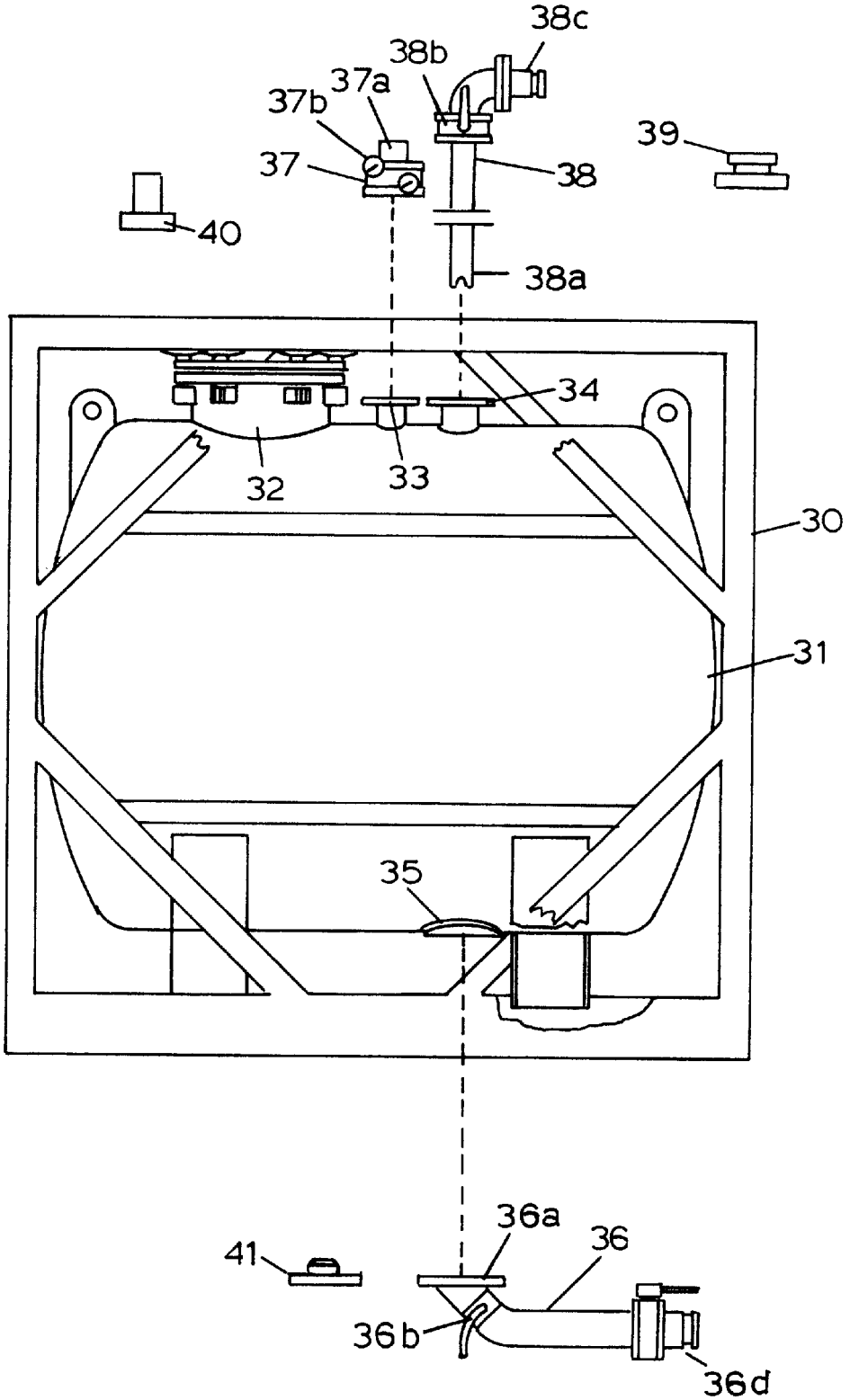
FIG. 3 is a side view of the preferred embodiment of the invention in an exploded format.

FIG. 3 represents the preferred convertible tank. Frame 30 carries generally cylindrical tank 31 and provides clearances, and needed support points, for the storage of optional port fittings that make the tank convertible. Flanged flow port 34 will accept bottom service fill port adapter assembly 39 for bottom discharge service, or top service adapter assembly 38 for top discharge service. Flanged pressure port 33 will accept manifold 37 for top discharge service or safety assembly 40 for bottom discharge service. Drain port 35 will accept drain control assembly 36 for bottom discharge service or adapter 41, which closes port 35 and stabilizes the standpipe 38*a* of assembly 38, for top discharge service.

For top discharge utility, the basic frame supported tank is fitted with assemblies 38, 37, and closure 41. For bottom discharge service the basic tank is fitted with accessories 36, 39, and 40.

The top service adapter assembly 38 comprises standpipe 38*a*, manual control valve 38*b* and connection adapter 38*c* for connection of service tubing. Pressure control assembly 37 comprises gauges, a pressure control device, which includes a rupture disc, and a connector adapter for external tubing connection. Closure 41 closes drain port 35 and has a projection to stabilize the stand pipe.

Drain control assembly 36 comprises port connector flange 36*a*, internal emergency close down valve 36*b*, manual control valve 36*c*, and adapter 36*d* for connection of external tubing. The pressure safety valve 40 has an external tubing adapter, and bottom service fill port adapter 39 has means to attach to the flow port flange 34 and means to attach external service tubing.

Space between the generally cylindrical tank and the rectangular frame affords space for storing the accessories for converting the tank between bottom and top discharge configurations on site, and that can be done in a few minutes.

When and where rules and circumstance permits, bolted flanged connections can be replaced by any of the several available quick coupler systems for connecting the changeable features to the tank ports. Band clamps are an example of available options.

It will be understood that certain features and sub-combinations are of utility and may be employed without reference to other features and sub-combinations. This is contemplated by and is within the scope of the claims.

As many possible embodiments may be made of the orienting motor of this invention without departing from the scope thereof, it is to be understood that all matter herein set forth or shown in the accompanying drawings is to be interpreted as illustrative and not in a limiting sense.

The invention having been described, I claim:

1. A frame enclosed and supported environmental, sealable, tank unit for storing, transporting, and processing of materials capable of fluid flow, the tank unit comprising:

a) a generally rectangular frame arranged to support and protect said tank;

b) a closable and sealable generally cylindrical tank situated in said frame, said tank having at least two top ports for passing materials into and out of said tank, and at least one bottom port for passing materials into and out of said tank c) at least two port accessory sets including one top discharge service set and one bottom discharge service set.

d) said top discharge service set including at least; 1- a top service adapter including at least a standpipe, and a discharge outlet with a control valve, 2- a drain port closure, and 3- a pressurization control assembly, including a safety pressure release, at least one gage, and a rupture disc;

e) said bottom discharge service accessory set including at least, 1- a fill port connector, 2- a safety pressure release, and 3- a drain control assembly which includes an internal emergency close down valve, a manual control valve, and a discharge connector.

2. The improved environmental tank unit of claim 1 wherein said two top ports include one pressure control port and one flow port, said pressure control port arranged to interchangeably receive, for fluid tight attachment, said pressurization control assembly or said safety pressure release.

3. The improved environmental tank unit of claim 2 wherein said flow port is arranged to interchangeably receive, for fluid tight attachment, said top service adapter or said fill port connector.

4. The improved environmental tank unit of claim 1 wherein said bottom port is arranged to interchangeably receive, for fluid tight attachment, said drain control assembly or said drain port closure.

5. The improved environmental tank unit of claim 1 wherein said tank has a manway on the top with a sealably securable cover for fluid tight closure of said manway.

* * * * *